US006027198A

United States Patent [19]

Tanaka et al.

[11] Patent Number: 6,027,198

[45] **Date of Patent: *Feb. 22, 2000**

[54] RECORDING HEAD AND RECORDING APPARATUS DIVISION BLOCK DRIVING

[75] Inventors: Sohei Tanaka; Masafumi Wataya, both of Kawasaki; Noriyuki Suzuki, Tokyo; Yoshiaki Kaburagi; Hiroshi Uemura, both of Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/301,570

[22] Filed: Sep. 7, 1994

[30] Foreign Application Priority Data

Sep. 8, 1993 [JP] Japan ..... 5-223497

[51] Int. Cl.[7] ..... B41J 29/38; B41J 2/05

[52] U.S. Cl. ..... 347/12; 347/57

[58] Field of Search ..... 347/12, 15, 180, 347/182, 57, 58, 43, 13

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,775,868 | 10/1988 | Sugiura | 347/43 |
| 5,142,374 | 8/1992 | Tajika et al. | 347/15 |
| 5,357,268 | 10/1994 | Kishida et al. | 347/13 |

FOREIGN PATENT DOCUMENTS

| | | | |
|---|---|---|---|
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 403153367 | 1/1991 | Japan | 347/182 |

*Primary Examiner*—John Barlow
*Assistant Examiner*—L. Anderson
*Attorney, Agent, or Firm*—Fitzpatrick, Cella, Harper & Scinto

[57] ABSTRACT

A recording head has a plurality of recording elements which are divided into a plurality of blocks and each block is driven in a time division fashion. The recording head has a signal generation circuit for generating an output signal for selecting a drive block in response to an input signal for designating the drive block from a main body of a recording apparatus. The number of signal lines of the input signal is smaller than the number of signal lines of an output signal. One such recording head is provided for each of a plurality of colors to record a color image. Signal lines of an input signal are common to the respective recording heads. Thus, the number of signal lines between the recording heads and the main body of the recording apparatus is reduced and cost reduction and space saving are attained.

8 Claims, 6 Drawing Sheets

RECORDING HEAD AND RECORDING APPARATUS DIVISION BLOCK DRIVING

BACKGROUND OF THE INVENTION

1. Field of the Invention

The present invention relates to recording head and recording apparatus in which a plurality of recording elements are divided into a plurality of blocks and each block is driven in a time division fashion.

2. Related Background Art

As a recording head of a printer, a thermal type of ink jet type of head, having a plurality recording elements is known. For example, an ink jet recording head which discharges ink to record data has a plurality of ink discharge nozzles arranged in a line and it is mounted on a carriage of a printer and prints data while it is moved by the carriage. A drive system therefor includes:

(1) a system in which ink is discharged from all nozzles at a time, and (2) a system in which the nozzles are divided in a plurality of blocks each comprising several nozzles and ink is discharged in the time division fashion.

However, in the time division system of (2) above, the same number of signal lines as the number of blocks are required to specify the blocks to discharge the ink. Further, in a recording head such as a color recording head having a plurality of discharge nozzles integrated in one line, a number of signal lines equal to the number of blocks by the number of lines are required.

Accordingly, a large wiring space and a multi-terminal connector are required for the electrical connection of the carriage and the recording head, this is a barrier to the miniaturization and the cost reduction.

SUMMARY OF THE INVENTION

It is an object of the present invention to provide an improved recording head and recording apparatus.

It is another object of the present invention to provide a recording head and recording apparatus which reduce the number of signal lines for the connection to a main body to attain cost reduction and space saving.

It is still another object of the present invention to provide a recording head and recording apparatus which significantly reduce the number of signal lines connected for the connection of the head, having a plurality of recording element lines connected to a main body, to attain cost reduction and space saving.

It is still another object of the present invention to provide a recording head and recording apparatus which simplify the connection of the recording head, having a plurality of recording element lines of different recording colors connected to a main body, to attain the cost reduction and the space saving.

Other objects of the present invention will be apparent from the drawings and the following description.

DETAILED DESCRIPTION OF THE PREFERRED EMBODIMENTS

[Embodiment 1]

Figure 1:
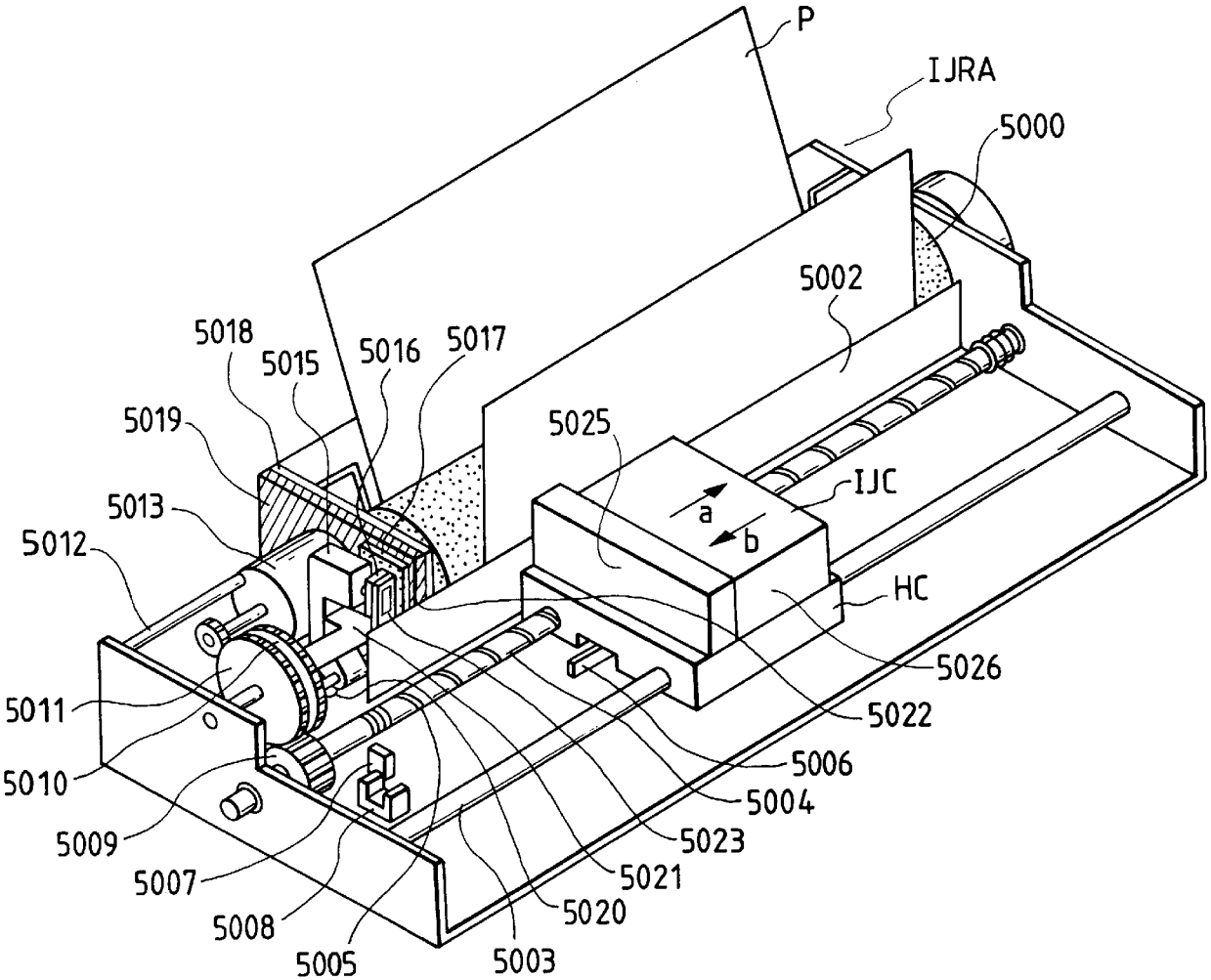
FIG. 1 shows a schematic configuration of a recording head having a detachable recording head in accordance with the present invention.

FIG. 1 shows an outer view of an ink jet recording apparatus IJRA to which a recording head of the present invention is applied. A carriage HC engages a spiral groove 5005 of a lead screw 5004, which is rotated by the forward and backward rotation of a drive motor 5013 through drive force transmission gears 5011 and 5009. The carriage HC has a connector (not shown) for electrical connection with the recording head and is reciprocally moved in directions a and b for record scan. In one or both of the reciprocal movements of the carriage HC, the recording head is driven and band lines corresponding to a recording width of the recording head are recorded on a record sheet P. A recording head 5025 and an ink tank 5026 are mounted on the carriage HC. Numeral 5002 denotes a sheet retainer which presses the sheet against a platen 5000 along a direction of movement of the carriage. Numerals 5007 and 5008 denote photo-couplers which form home position detection means for detecting the presence of a lever 5006 of the carriage in the region to switch a direction of rotation of the motor 5013. Numeral 5016 denotes a member for supporting a cap member 5022 for capping a front side of the recording head, and numeral 5015 denotes suction means for sucking the inside of the cap to recover ink via the suction of the recording head through a cap opening 5023. Numeral 5017 denotes a cleaning blade and numeral 5019 denotes a member for allowing back and forward movement of the blade, supported by a support plate 5018 of the main body. The blade need not be of the illustrated type and a known cleaning blade may be applied to the present embodiment. Numeral 5012 denotes a lever for starting the suction for the suction recovery. It is moved as a cam 5020, which engages the carriage, moves and the movement hereof is controlled by known transmission means which transmits a driving force from a driving motor.

The capping, the cleaning and the suction recovery are effected at respective positions by the action of the lead screw 5005 when the carriage HC is positioned at the home position region and any of those operations may be applied by conducting them at a desired timing.

The recording head cartridge is mounted on the carriage HC. In the recording head cartridge of the present embodiment, the recording head 5025 and the ink tank 5026 are separable. The recording head of the present embodiment has a plurality of discharge ports (64 ports) and discharge energy generating elements are provided, one for each discharge port, and printing is made on the record sheet P at a record density of 360 dpi by discharging ink droplets. In the present embodiment, electro-thermal transducer elements (hereinafter referred to as heaters) are used as the discharge energy generation elements and a change of state is caused in the ink by using the thermal energy generated by the heater to discharge the ink droplets from the discharge ports at the ends of the nozzles.

Figure 2:
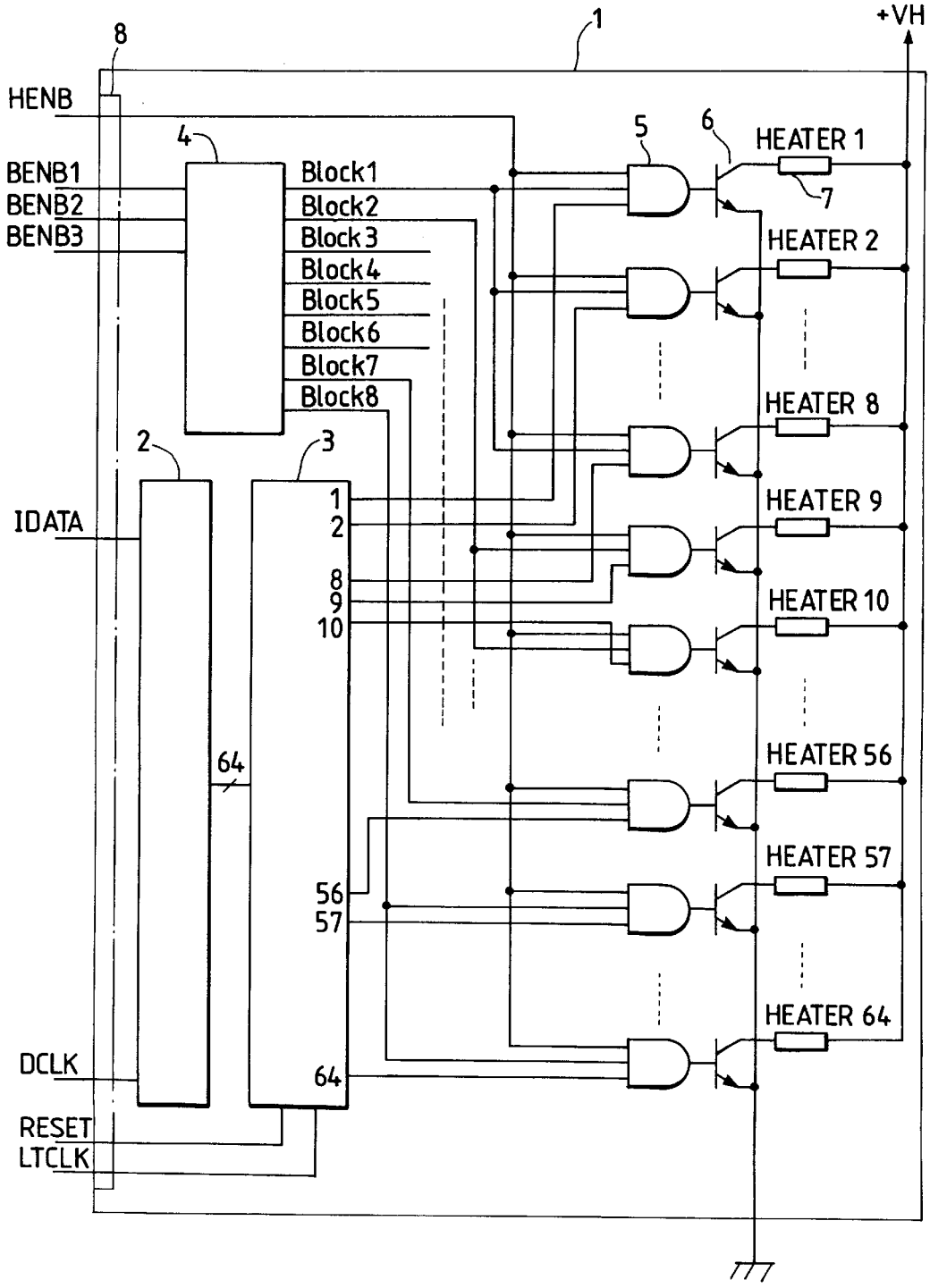
FIG. 2 shows a circuit diagram of a recording head of an embodiment 1 of the present invention.
Figures 3A, 3B, 3C, 3D, 3E, 3F, 3G, 3H, 3I, 3J, 3K, 3L, 3M:
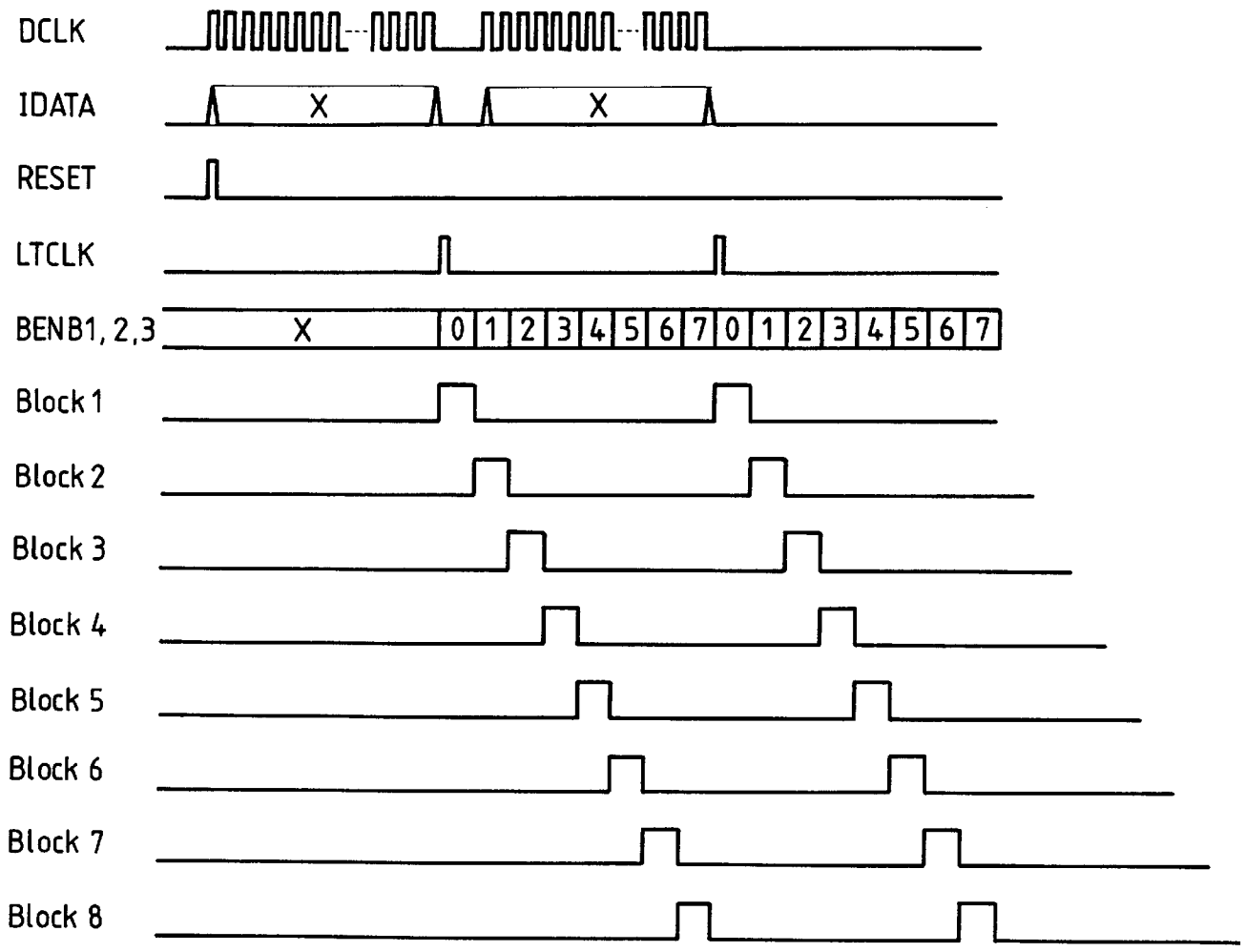
FIGS. 3A to 3M show timing charts of waveforms of signals in the circuit of FIG. 2.

FIG. 2 shows a block diagram of a circuit of the recording head 5025 in the present embodiment. It comprises various logic circuits and 64 ink discharging heaters. In the present embodiment, the 64 heaters are divided into blocks each comprising 8 heaters, and each block is driven in a time division fashion.

Numeral 1 denotes an entire recording head and receives various control signals and a supply of power from a control unit (not shown) which processes record data in the recording apparatus IJRA.

Numeral 2 denotes a 64-bit shift register which reads serial data IDATA in synchronism with a clock DCLK.

Numeral 3 denotes a 64-bit latch register which reads the data of the bit shift register 2 at the rise of the latch signal LTCLK. The content of the latch register 3 is cleared by a reset signal RESET.

Numeral 4 denotes a 3-to-8 decoder which decodes 3-bit signals BENB1, BENB2 and BENB3 for designating a drive block sent from the recording apparatus main body to an 8-bit signal, and the signals Block1, Block2, Block3, Block4, Block5, Block6, Block7 and Block8 on the eight signal lines are supplied to input terminals of eight 3-input AND gates 5 and outputs of the AND gates are supplied to base terminals of transistors 6 which turn on and off the discharge heaters 7. The AND gate, the transistors and the discharge heaters are arranged in an 18×8=64 matrix.

Numeral 8 denotes a connector for electrical connection with the main body of the recording apparatus and the control signals and data sent from the main body are applied thereto.

A signal HENB determines a pulse width of the pulse signal which drives the heaters 7. It is turned on for a predetermined period while the block designation signal for designating the block is on.

FIGS. 3A to 3M show timing charts of waveforms of signals in FIG. 2. Before the start of scan by the carriage HC, the reset signal RESET is outputted to clear the content of the latch register 3, and the record data IDATA is transferred to the shift register 2 in synchronism with the clock signal DCLK. When the 64-bit data is stored in the shift register 2, the latch signal LTCLK is outputted and the content of the shift register 2 is read into the latch register 3. The blocks designated by the 3-bit signals BENB1 to BENB3 are sequentially selected and the heaters in the selected blocks are driven for the time period in which the signal HENB is on in accordance with the data latched in the latch register 3. For example, when the signal level of (BENB1, BENB2, BENB3) is (0, 0, 0), the signal BLOCK1 from the decoder 4 is on and the heaters 1 to 8 are driven in accordance with the latch data. Similarly, when the signal levels of (BENB1, BENB2, BENB3) are (0, 0, 1), (0, 1, 0), . . . (1, 1, 1), the signals BLOCK2, BLOCK3, . . . , BLOCK7 from the decoder 4 are on, respectively, and the heaters in the respective blocks are driven in accordance with the latch data. While the blocks 1 to 8 are driven, the record data for the next 64 bits is stored in the shift register 2 in synchronism with the block signal DCLK.

When the drive of the blocks 1 to 8 is completed, the latch signal LTCLK is again outputted and the data stored in the shift register 2 is read into the latch register 3 and the blocks 1 to 8 are selected in a similar manner. Thereafter, the above operation is completed until one scan is completed, and when one scan is completed, the reset signal RESET is outputted again before the start of the next scan and a similar operation is conducted for each recording operation.

[Embodiment 2]

Another embodiment of the present invention is now explained. In the present embodiment, four recording heads for color recording of black (BK), cyan (C), magenta (M) and yellow (Y) are integrated in a recording head unit. The signals DCLK, RESET, LTCLK, BENB1, BENB2 and BENB3 of FIG. 2 are used in common to reduce the signal lines to 14 lines.

Figure 4:
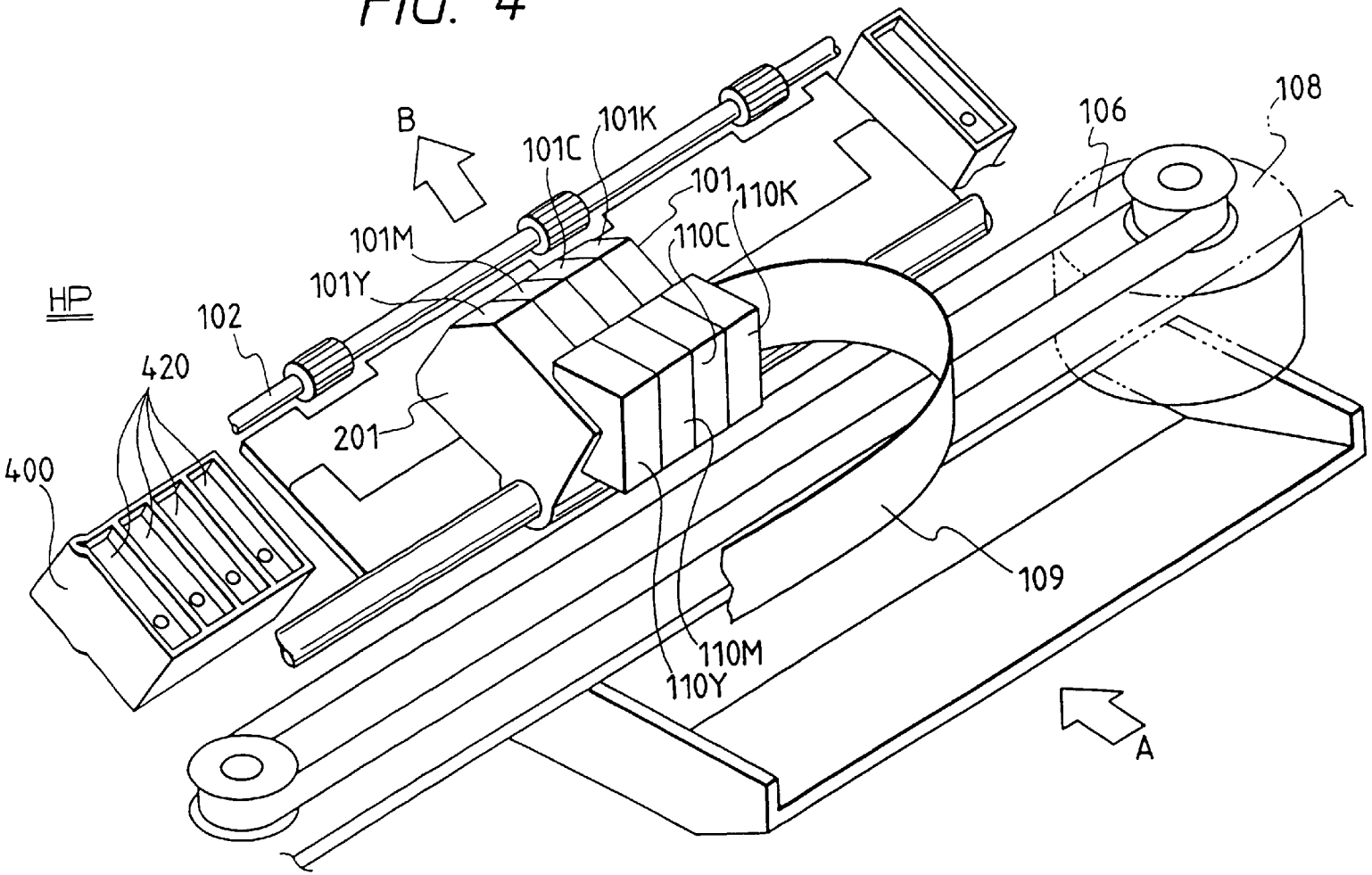
FIG. 4 shows a schematic configuration of a recording apparatus having a detachable recording head of an embodiment 2 of the present invention.

FIG. 4 shows a perspective view of a configuration of the color ink jet recording apparatus.

The recording head unit 101 has head lines of respective colors each having a plurality of nozzle lines and records an image on a recording medium in dot form by discharging ink droplets. Inks of different colors are discharged from different head lines and a color image is formed on the recording medium by mixing those color ink droplets. In the present embodiment, the printing head discharges ink droplets from the discharging ports by causing a change of state in the ink by using thermal energy. The respective color head lines print at a recording density of 360 dpi. The print data is transmitted from the electrical circuit of the printer to the head through the connector and the cable 109. The print head lines 101K (black), 101C (cyan), 101M (magenta) and 101Y (yellow) are mounted on the carriage 201 and they discharge the ink in this order during one scan. For example, when red (R) is to be formed, magenta (M) is first deposited to the recording medium, then yellow (Y) is deposited on the M dot so that the red dot appears. When green (G) is to be formed, C and Y are deposited in sequence, and when blue (B) is to be formed, C and M are deposited in sequence. Since the respective head lines are arranged at a predetermined pitch (P1), when G is to be printed in blanket, C is printed and then Y is printed 2*P1 later. Namely, Y is blanket printed on the C blanket printing. The carriage 201 detects the scan speed of the carriage and the print position by the speed detection means (not shown) to control the movement in the main scan direction. A motive force therefor is he carriage drive motor 108 and it is transmitted by a belt 106 to move along the sliding shaft. During the operation in the main scan direction, the printing in the digit direction is made. The print operation in the digit direction may be done by uni-directional printing or bidirectional printing. In the uni-directional printing, the printing is performed only when the carriage is moved off the home position HP (forward direction) and the printing is not performed in a direction to move back to the home position (backward direction). Thus, high precision printing is attained. On the other hand, in bidirectional printing, the printing is performed in both the forward direction and the backward direction. Accordingly, high speed printing is attained.

The recovery unit 400 has a function to keep the print head in good condition. In the non-print state, the cap line 420 blocks the discharge plane of the print head to prevent the drying thereof. Thus, the position at which the carriage 201 faces the recovery unit 400 is called the home position HP.

The function of the recovery unit during the print operation is explained. In the actual print operation, not all of the nozzles in one head are always used. Where multi-color printing head is provided, the print data may not be transferred to some of the heads (non-operating heads). If the ink is not discharged for a predetermined time period during the carriage scan (while the print head is not capped), the ink discharge ability is lowered by the adhesion and drying of the ink on the surface of the print head and image quality is degraded. In order to prevent this phenomenon, the print head discharges the ink by using the nozzle in the head for other than printing data at a predetermined interval to keep the surface of the print head in an optimum condition. This operation is called the preliminary discharge. The ink discharged by the preliminary discharge is discharged toward the cap 420 in the recovery unit 400 to prevent the recording medium and the inside of the printer from being contaminated by the scattered ink, and it is sucked up by the recovery pump (not shown) and stored in the exhaust tank.

When the preliminary discharge operation is to be performed, the carriage 201 should be returned to HP to face the cap line 420 in both uni-directional printing and bidirectional printing. In the sub-scan direction feed, the recording medium is fed by a sheet feed member (rubber roller) driven by a sheet feed motor (not shown). The sheet is fed in the direction A and when it reaches the print position, the printing is made by the head line. Then, it is ejected in the direction B by the sheet ejection mechanisms. The inks of respective colors are fed to the head lines from the ink cassettes 110K, 110C, 110M and 110Y.

Figure 5:
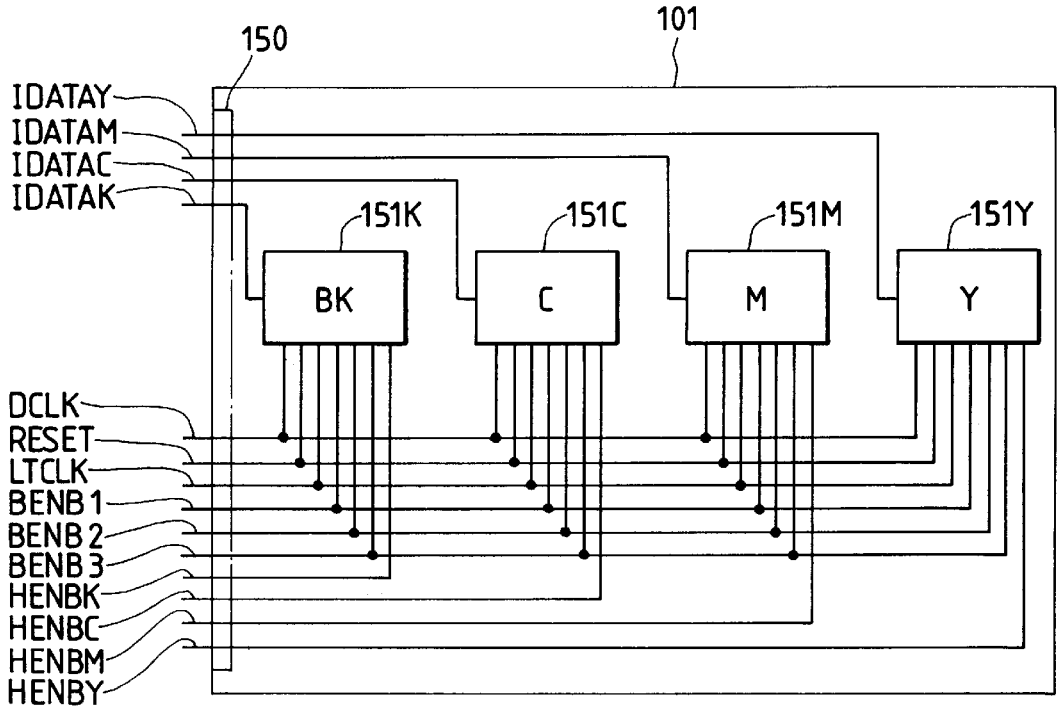
FIG. 5 shows a circuit diagram of a recording head of the embodiment 2 of the present invention.

FIG. 5 shows a block diagram of a circuit of the recording head unit 101. Numeral 150 denotes a connector for the electrical connection with the main body of the recording apparatus and various control signals and data are applied thereto. Numerals 151K, 151C, 151M and 151Y denote circuits for driving black, cyan, magenta and yellow recording head lines, and they are of the identical configuration to that of FIG. 2. IDATAY, IDATAM, IDATAC and IDATAK denote yellow, magenta, cyan and black serial record data. HENBY, HENBM, HENBC and HENBK denote signals for determining pulse widths of pulse signals for driving the heaters of the yellow, magenta, cyan and black heads lines. DCLK, RESET, LTCLK, BENB1, BENB2 and BENB3 denote the same signals as those of the embodiment 1 and those signals are used in common for the respective color heads.

When the circuit configuration of FIG. 2 is provided independently for each color head line, 8×4=32, signal lines are required but in the present embodiment, the number of signal lines is reduced to 14.

[Embodiment 3]

Figure 6:
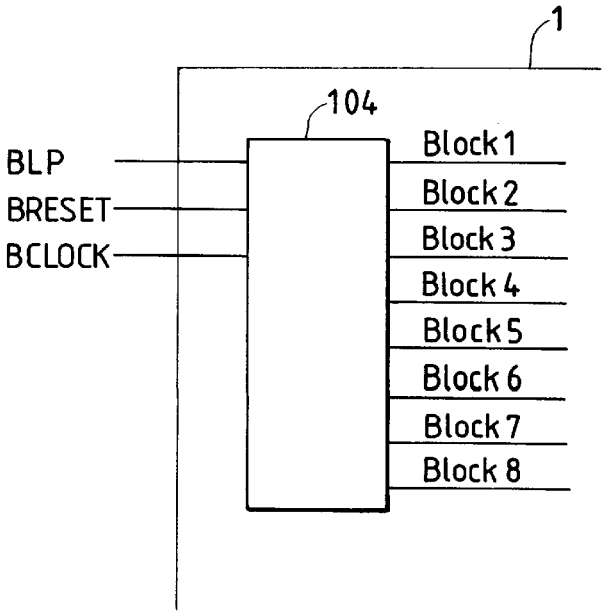
FIG. 6 shows a circuit diagram of a recording head of an embodiment 3 of the present invention.

FIG. 6 shows a block diagram of a circuit configuration of a recording head of other embodiment of the present invention. In the present embodiment, the 3-to-8 decoder 4 of the Embodiment 1 is replaced by an 8-bit shift register 104. Other elements are the same as that of FIG. 2. A recording apparatus to which the present embodiment may be applied has a configuration similar to that shown in FIG. 1. The shift register 104 receives shift data BLP and shifts it one bit at a time by a rise of an input clock signal BCLOCK, and block designation signals Block1 to Block8 are sequentially turned on as the data is shifted. A signal BRESET is a reset signal to start the block designation by the shifting synchronized with the clock signal beginning from Block1.

Figures 7A, 7B, 7C, 7D, 7E, 7F, 7G, 7H, 7I, 7J, 7K, 7L, 7M, 7N, 7O:
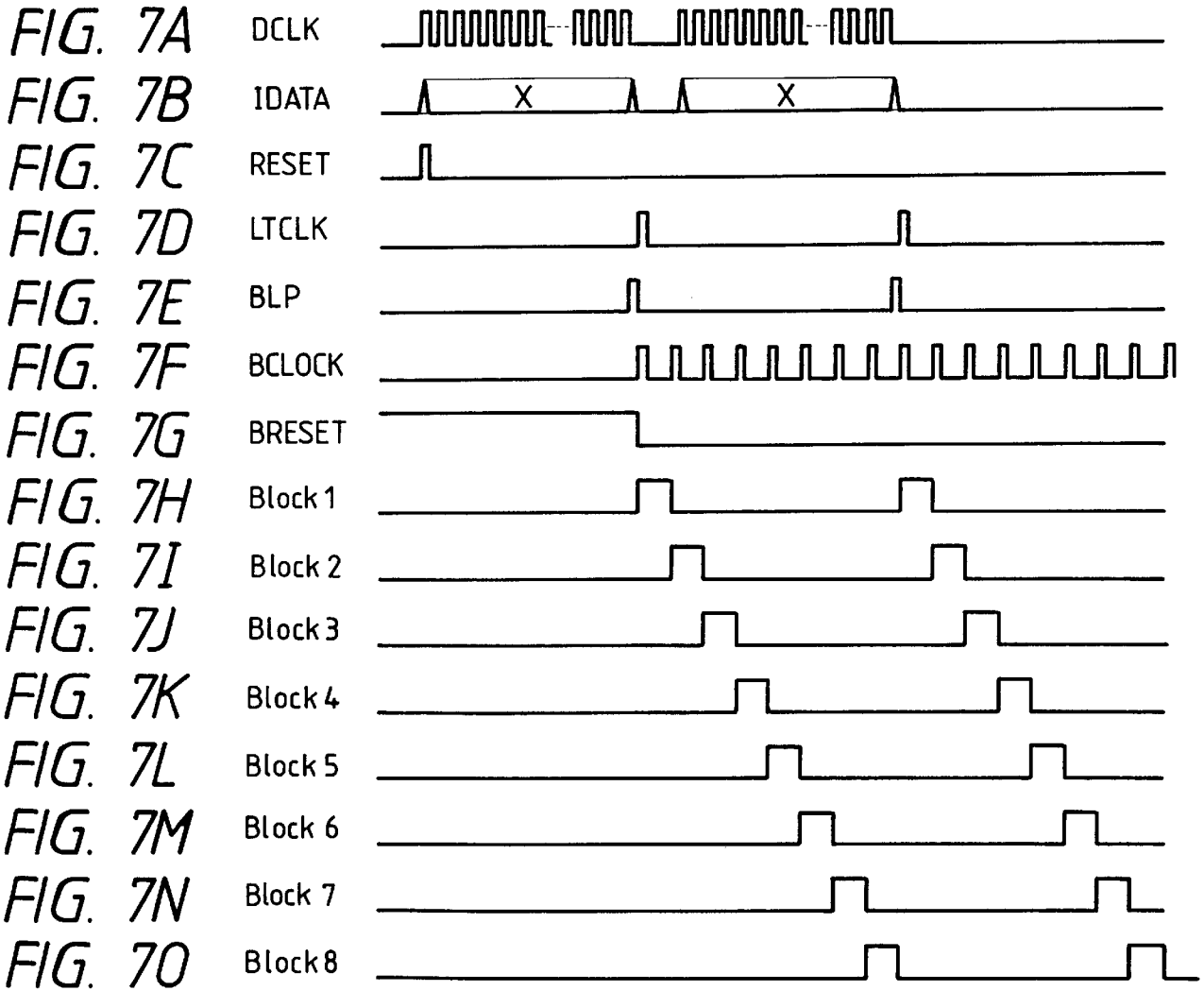
FIGS. 7A to 7O show timing charts of waveforms of signals in the circuit of FIG. 6.

FIGS. 7A to 7O show timing charts of waveforms of signals of the circuit shown in FIG. 6. Before the start of the scan by the carriage HC, the reset signal RESET is outputted to clear the content of the latch register 3 and the record data IDATA is transferred to the shift register 2 in synchronism with the clock signal DCLK. When 64-bit data is stored in the shift register 2, the latch signal LTCLK is outputted and the content of the shift register 3 is read into the latch register 3. Each time the clock signal BCLOCK is applied, the signals Block1 to Block8 are sequentially turned on. The heater in the designated block is driven for the on time of the signal HENB based on the data latched in the latch register 3.

During the drive of the Block1 to Block8, the next 64-bit record data is stored in the shift register 2 in synchronism with the clock signal DCLK.

When the drive of the Block1 to Block8 is completed, the latch signal LTCLK is again outputted and the data stored in the shift register 2 is read into the latch register 3 and the Block1 to Block8 are selected in the same manner. Thereafter, the above operation is repeated until one scan is completed, and after the completion of one scan, the reset signal RESET is again outputted before the scan is started and the similar operation is conducted for each completion of recording of one page.

In accordance with the present embodiment, the number of the signal lines is further reduced compared to the Embodiment 1 which uses the decoder.

As described above, where the recording heads having the recording elements are divided into a plurality of blocks and driven in the time division fashion, the drive block designation signal is generated in the recording head to reduce the number of signal lines. Accordingly, (1) the number of lead wires is reduced, and (2) the number of connector pins is reduced so that cost reduction and space saving are attained.

(3) Further, since the signal lines of the recording head make electrical conduction by the pressurized contact of the electrodes formed on the electrical board of the head and the contact terminals formed on the flexible board, the number of electrodes is reduced and a stable connection is attained.

(4) In addition, in color recording, the recording heads for four colors are integrated so that the above effects are further enhanced.

In the embodiments, a ink jet recording head which forms flying droplets by utilizing thermal energy to record the data has been explained. The typical construction and the operational principles thereof are preferably the ones disclosed in U.S. Pat. Nos. 4,723,129 and 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through an discharge port to produce at least one droplet. The driving signal is preferably in the form of a pulse because the development and the contraction of the bubbles can be effected instantaneously, and therefore the liquid (ink) is ejected with a fast response.

The pulse driving signal is preferably such as those disclosed in U.S. Pat. Nos. 4,463,359 and 4,345,262. In addition, the temperature rise rate of the heating surface is preferably such as those disclosed in U.S. Pat. No. 4,313,124.

The structure of the recording head may be those shown in U.S. Pat. Nos. 4,558,333 and 4,459,600 in which the heating portion is disposed at a bent portion, as well as the structure of the combination of the ejection outlet the liquid passage and the electro-thermal transducer disclosed in the above-mentioned patents.

In addition, the present invention is applicable to the structure disclosed in Japanese Laid-Open Patent Application No. 59-123670 in which a common slit is used as the discharge port for a plurality of electro-thermal transducers, and the structure disclosed in Japanese Laid-Open Patent Application No. 59-138461 in which an opening for absorbing a pressure wave of thermal energy is formed corresponding to the discharge port.

The present invention is effectively applicable to a so-called full-line type recording head having a length corresponding to the maximum recording width. Such a recording head may comprises a single recording head and plural recording head combined to cover the maximum width.

In addition, the present invention is applicable to a serial type recording head in which the recording head is fixed on a main assembly, to a replaceable chip type recording head which is connected electrically with the apparatus and can be supplied with the ink when it is mounted in the main assembly, or to a cartridge type recording head having an integral ink container.

The provision of the recovery means and/or the auxiliary means for the preliminary operation are preferable because they further stabilize the effects of the present invention. As for such means, there are capping means for the recording head, cleaning means therefor, pressing or sucking means, preliminary heating means which may be an electro-thermal transducer, an additional heating element or a combination thereof. Also, means for effecting preliminary discharge (not for the recording) may stabilize the recording operation.

Furthermore, in the foregoing embodiment, the ink is liquid. Alternatively, ink which is solidified below room temperature and liquefied at room temperature may be used. Since the ink is controlled within a temperature range of not lower than 30° C. and not higher than 70° C. to stabilize the viscosity of the ink to provide the stable discharge in a conventional recording apparatus of this type, the ink may be such that it is liquid within the temperature range when the recording signal is applied.

In addition, the temperature rise due to the thermal energy is positively prevented by consuming it for the state change of the ink from the solid state to the liquid state. Other ink is solidified when it is left, to prevent the evaporation of the ink. In any case, the application of the recording signal produces thermal energy, the ink is liquefied, and the liquefied ink may be discharged. Other ink may start to be solidified at the time when it reaches the recording sheet. The present invention is also applicable to ink which is liquefied by the application of the thermal energy. Such ink may be retained in liquid state or solid state in holes or recesses formed in a porous sheet as disclosed in Japanese Laid-Open Patent Application No. 54-56847 and Japanese Laid-Open Patent Application No. 60-71260. The sheet faces to the electro-thermal transducers. The most effective one of the inks described above is the film boiling system.

The ink jet recording apparatus may be used as an output terminal of an information processing apparatus such as a word processor or a computer in a built-in type or a standalone type as well as a copying machine combined with an image reader or a facsimile machine having information sending and receiving functions.

The present invention is applicable to not only an ink jet system which uses thermal energy but also to an ink jet system using a piezo-electric element.

In accordance with the present invention, the signal generation means for designating the drive block during the block drive mode is provided in the recording head mounted on the main body of the recording apparatus so that the drive block may be designated from the main body by a smaller number of input signal lines than the number of signal lines for designating the block and cost reduction and space saving are attained.

Further, in the recording head having the recording element lines for different colors, the input signal lines are common to the recording element lines so that the number of signal lines is significantly reduced in the color recording head.

What is claimed is:

1. A recording head mounted on a mount means of a recording apparatus for recording a color image in accordance with data sent from the main body of the recording apparatus, comprising a plurality of recording head units for recording respective different color images, each of said recording head units comprising:

a recording element group having a plurality of recording elements and being divided into m blocks, where m is an integer greater than 2;

transmitting means for transmitting the data to said plurality of recording elements;

a selection circuit for inputting n block selection signals and selecting at least one block to be driven from the m blocks, where n<m; and means for supplying a signal to determine driving periods of said plurality of recording elements, wherein the n block selection signals are commonly supplied to said plurality of recording head units, and the signal to determine driving periods of the recording elements is separately supplied to each of said recording head units.

2. A recording head according to claim 1, wherein said signal supplying means includes a decoding circuit for decoding an n-bit signal to an m-bit signal.

3. A recording head according to claim 1 or 2, wherein said plurality of recording elements discharge ink droplets to record the data on a recording medium.

4. A recording head according to claim 3, wherein said plurality of recording elements discharge ink droplets by causing a change of state in ink by using thermal energy applied to the ink to generate bubbles.

5. A recording apparatus comprising:

(i) a recording head comprising a plurality of recording head units for recording respective different color images, each of said recording head units comprising:

a recording element group having a plurality of recording elements and being divided into m blocks, where m is an integer greater than 2;

transmitting means for transmitting data to said plurality of recording elements;

a selection circuit for inputting n block selection signals and selecting at least one block to be driven from the m blocks, where n<m; and means for supplying a signal to determine driving periods of said plurality of recording elements;

(ii) mount means for mounting said recording head thereon;

(iii) connecting means for making a connection, when said recording head is mounted on said mount means, to send the block selection signals to said selection circuit and further send the data corresponding to the respective different color images to said transmitting means of each of said recording head units, respectively; and (iv) scan means for record-scanning said recording head mounted on said mount means, wherein the n block selection signals are commonly supplied to said plurality of recording head units, and the signal to determine driving periods of the recording elements is separately supplied to each of said recording head units.

6. A recording apparatus according to claim 5, wherein said signal supplying means includes a decoding circuit for decoding an n-bit signal to an m-bit signal.

7. A recording apparatus according to claim 5 or 6, wherein said Plurality of recording elements discharge ink droplets to record the data on a recording medium.

8. A recording apparatus according to claim 7, wherein said plurality of recording elements discharge ink droplets by causing a change of state in ink by using thermal energy applied to the ink to generate bubbles.

* * * * *

UNITED STATES PATENT AND TRADEMARK OFFICE

CERTIFICATE OF CORRECTION

PATENT NO. : 6,027,198
DATED : February 22, 2000
INVENTOR(S) : Tanaka et al.

It is certified that error appears in the above-identified patent and that said Letters Patent is hereby corrected as shown below:

Title page,
Item [54], "RECORDING HEAD AND RECORDING APPARATUS DIVISION BLOCK DRIVING" should read -- RECORDING HEAD AND RECORDING APPARATUS HAVING TIME DIVISION BLOCK DRIVING --.

Column 1:
Lines 1 and 2, "RECORDING HEAD AND RECORDING APPARATUS DIVISION BLOCK DRIVING" should read -- RECORDING HEAD AND RECORDING APPARATUS HAVING TIME DIVISION BLOCK DRIVING --.
Line 34, "head," should read -- head; --.

Column 2:
Line 44, "hereof" should read -- thereof --.

Column 6:
Line 59, "outlet" should read -- outlet, --.

Signed and Sealed this

Fourth Day of September, 2001

*Attest:*

Nicholas P. Godici

*Attesting Officer*

NICHOLAS P. GODICI
*Acting Director of the United States Patent and Trademark Office*